US011044973B1

(12) United States Patent
Easterwood et al.

(10) Patent No.: US 11,044,973 B1
(45) Date of Patent: Jun. 29, 2021

(54) APPARATUSES AND METHODS FOR PORTABLE COMBINED BED AND STORAGE

(71) Applicants: Taylor Ali Easterwood, Leawood, KS (US); Farrah Walker, Leawood, KS (US)

(72) Inventors: Taylor Ali Easterwood, Leawood, KS (US); Farrah Walker, Leawood, KS (US)

( * ) Notice: Subject to any disclaimer, the term of this patent is extended or adjusted under 35 U.S.C. 154(b) by 416 days.

(21) Appl. No.: 15/954,588

(22) Filed: Apr. 16, 2018

Related U.S. Application Data

(60) Provisional application No. 62/486,094, filed on Apr. 17, 2017.

(51) Int. Cl.

| | |
|---|---|
| ***A45C 9/00*** | (2006.01) |
| ***A45C 5/03*** | (2006.01) |
| ***A45C 5/14*** | (2006.01) |
| ***A45C 13/00*** | (2006.01) |
| ***A47G 9/10*** | (2006.01) |
| ***A47C 19/14*** | (2006.01) |
| ***A47C 27/08*** | (2006.01) |

(52) U.S. Cl.
CPC ..... *A45C 9/00* (2013.01); *A45C 5/03* (2013.01); *A45C 5/14* (2013.01); *A45C 13/005* (2013.01); *A47C 19/14* (2013.01); *A47C 27/081* (2013.01); *A47G 9/10* (2013.01); *A45C 2005/035* (2013.01); *A45C 2005/037* (2013.01)

(58) Field of Classification Search
CPC ..... A47C 17/82; A47C 19/14; A47C 27/08; A45C 9/00; A45C 5/14; A45C 5/03; A45C 13/06; A45C 2005/037; A45C 2005/035; A45C 13/005; A47G 9/10
USPC ..... 190/2, 20; 5/182, 159, 419
See application file for complete search history.

(56) References Cited

U.S. PATENT DOCUMENTS

| | | | | | |
|---|---|---|---|---|---|
| 956,219 | A * | 4/1910 | Stern | | |
| 1,120,480 | A * | 12/1914 | Haskes | A45C 9/00 | 190/2 |
| 1,733,916 | A * | 10/1929 | Spalding | A45F 4/06 | 190/2 |
| 2,224,846 | A * | 12/1940 | Anderschitz | A45C 7/02 | 190/2 |
| 4,049,411 | A * | 9/1977 | Long | C03B 37/02 | 65/478 |
| 5,611,414 | A * | 3/1997 | Walker | A47C 17/82 | 190/2 |
| 8,439,174 | B1 * | 5/2013 | Miranda | A45C 9/00 | 190/1 |
| 8,875,854 | B2 * | 11/2014 | Zuckerman | A45C 5/03 | 190/2 |
| 9,357,824 | B2 * | 6/2016 | McDonald | A47C 27/081 | |
| 2002/0164162 | A1 * | 11/2002 | Onozuka | G03B 17/02 | 396/85 |

(Continued)

*Primary Examiner* — Sue A Weaver
(74) *Attorney, Agent, or Firm* — Diana Mederos; Mederos Legal, PLLC

(57) ABSTRACT

A portable combined bed and storage apparatus and methods of assembling thereof. The combined bed and storage apparatus provides for an efficient and convenient way to transport one's personal items, linens, and sleeping surface such as a mattress. The combined bed and storage apparatus configuration prevents items from getting lost and allows for quick assembly, disassembly, and stowage.

6 Claims, 7 Drawing Sheets

(56) References Cited

U.S. PATENT DOCUMENTS

2011/0088986 A1* 4/2011 Chen ..... A47C 27/082
190/2
2013/0256072 A1* 10/2013 Farhat ..... A01G 9/16
190/2

* cited by examiner

APPARATUSES AND METHODS FOR PORTABLE COMBINED BED AND STORAGE

CROSS REFERENCE TO RELATED APPLICATION

This application claims the benefit of U.S. Provisional Application No. 62/486,094, entitled Apparatuses and Methods for Portable Combined Bed and Storage, filed Apr. 17, 2017, which is hereby incorporated by reference in its entirety for all purposes.

FIELD OF THE DISCLOSURE

The present disclosure relates to methods and apparatuses for a portable combined bed and storage. More specifically, the present disclosure presents a portable carry-case with integrated bed and storage modules and methods of assembling thereof.

BACKGROUND OF THE DISCLOSURE

People travel more than ever, whether it is a day trip or a world cruise. Travelers are always looking for ways to minimize the amount of gear and luggage required. Backpackers are known for taking a minimalist approach by packing clothing, toiletries, and other travel gear in a backpack. It is similar with hikers and campers as well. Backpackers typically seek refuge in inexpensive vacation rentals, hostels, or with friends and family. Campers and those intending on staying as a guest in someone's home for a night or two will typically need to bring their own blankets and pillows or sleeping bag to be comfortable.

Traveling with sleeping gear is often bulky. For example, air mattresses and sleeping bags are heavy even when rolled up. Even when sleeping bags and air mattresses are rolled up, they take up a lot of space-sometimes more than the traveler's backpack or other luggage. The rolled-up air mattress or sleeping bag are carried in addition to a dedicated piece of luggage or are removably attached to the exterior of a dedicated piece of luggage such as a backpack or suitcase.

A small air mattress or sleeping bag may be rolled up and placed inside a large backpack or piece of luggage. However, the air mattress or sleeping bag will take up most, if not all, of the room of the interior of the large backpack or luggage. It will also ruin, wrinkle, or smash other travel necessities such as toiletries and clothing.

Toddlers and school-age children also have sleepovers at their friends' houses and have nap time at school or daycare. Presently, these children use mats similar to but less dense than gymnastics mats but thicker than yoga mats for nap time. School-age children sleeping over at a friend's or family member's house will traditionally either sleep in a guest bedroom, on the couch, or share a bed with someone else. This is not always comfortable or convenient for the guest.

Currently, attempts at combining luggage with a bed are too expensive, too heavy, and do not provide for easy bed setup and stowage.

SUMMARY OF THE DISCLOSURE

What is needed are apparatuses and methods for portable combined bed and storage as described and claimed herein.

A portable combined bed and storage in the form of a carry-case. The carry-case is comprised of a shell with at least one storage module, at least one mattress, and least one closure.

Some embodiments of a portable combined bed and storage in the form of a carry-case may further comprise a barrier, bed linens, partition, at least one hinge, at least one wheel, or combinations thereof.

Some embodiments of a portable combined bed and storage in the form of a carry-case may have a soft shell or a hard shell. Hard shell embodiments have a frame.

Embodiments of the portable combined bed and storage are assembled by creating a frame and covering the frame with a barrier to create a shell. The shell interior is suitable for accommodating at least one mattress and at least one storage module.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure. The drawings are organized and discussed by figure number.

Figure 1:
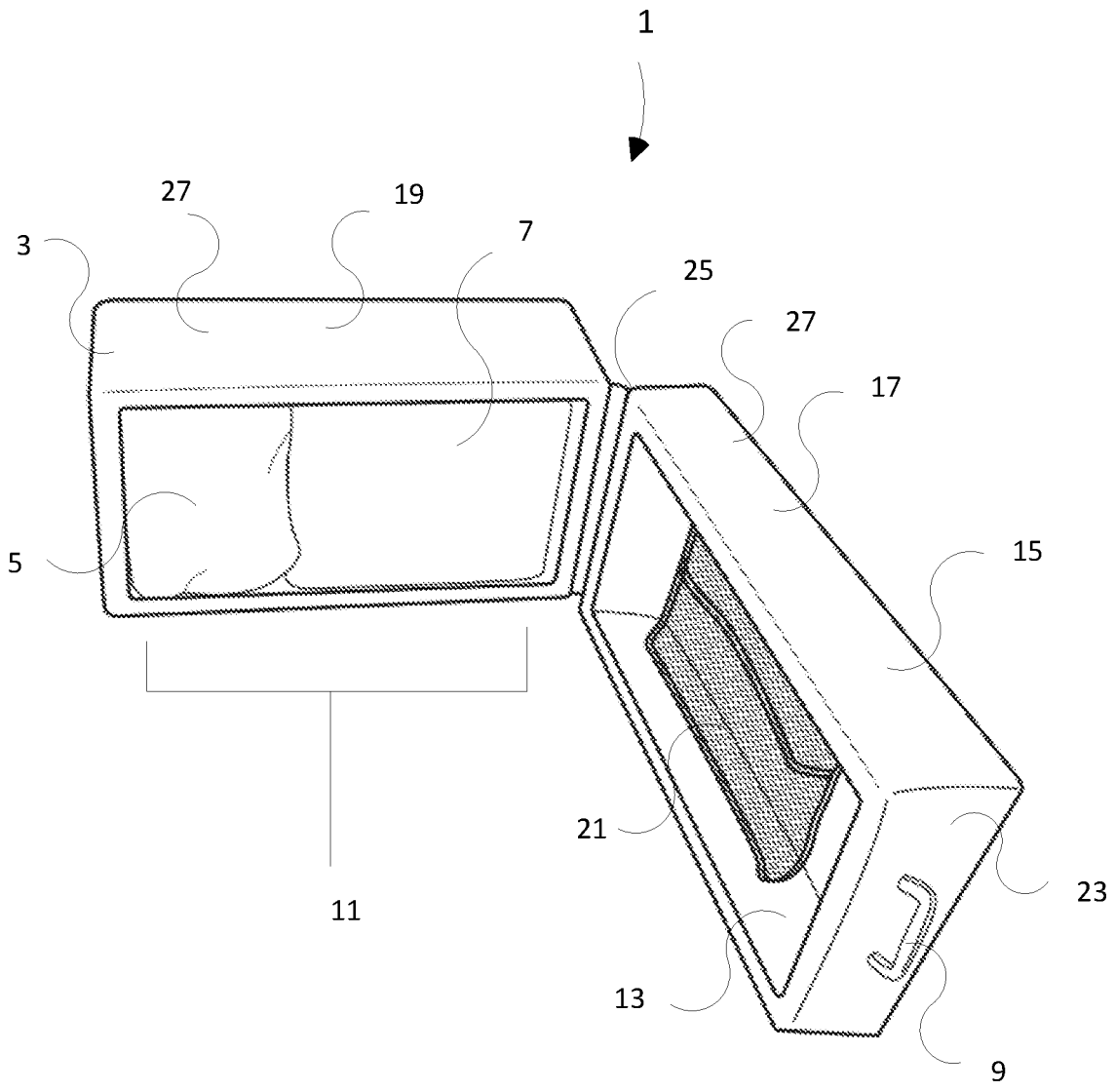
FIG. 1 illustrates a perspective view of an exemplary portable combined bed and storage in an open position.

The following numerals are represented in the drawings:

1 apparatus
3 carry case
5 pillow
7 linens
9 handle
11 bed
13 interior space
15 exterior space
17 top portion
19 bottom portion
21 storage module
23 side

25 hinge
27 shell
29 front access cover
31 air pump
33 closure
35 mattress
37 barrier
39 wheel
41 partition
43 frame
45 fastener
47 base frame
49 pipe
51 frame head
53 frame foot
55 frame leg
57 cord
59 segment
61 cross support structure
63 connector
65 upper cross support
67 lower cross support
69 scissor mounting bracket
71 scissor frame assembly

DETAILED DESCRIPTION

In the following sections, detailed descriptions of examples and methods of the disclosure will be given. The description of both preferred and alternative examples are exemplary only, and it is understood that to those skilled in the art that variations, modifications, and alterations may be apparent. It is therefore to be understood that the examples do not limit the broadness of the aspects of the underlying disclosure as defined by the claims.

The present disclosure provides generally for apparatuses and methods for portable combined bed and storage. The exemplary embodiments herein present a carry-case that may be hard shell or soft shell. The shell of the carry case defines the interior space and the exterior space. The shell may be comprised of at least one barrier. An example of a soft-shell barrier would be nylon, canvas, leather, or faux leather that is not structured. Rather, the soft-shell barrier is in more of a compressible bag-type form such as a drawstring or duffel bag. A soft-shell carry case may not have a lid and a bottom. Instead, it may have a base and an opening. An example of a hard-shell barrier would be a molded carbon fiber or plastic shell or a rigid frame structure with a soft or expandable material such as leather, vinyl, nylon, or canvas.

The interior space houses a bed having a mattress that can fold or collapse into the interior space of the carry case. The interior space also comprises at least one storage module for securing or holding travel accessories, clothes, toiletries, or extra linens. A partition may separate the mattress or bed storage area from at least one more other compartments for storing travel essentials such as clothes, shoes, accessories, toiletries, additional blankets and linens, or at least one pillow.

A traveler opens the carry case on the floor by separating the lid or top portion from the bottom portion while the carry-case is in the lateral position and pulls out a segmented mattress frame to unfold a bed in one step. The mattress itself may also be segmented or may be one solid sheet of padding or foam. For stowage, the traveler folds each mattress frame segment over itself to return to its original position contained in the interior portion of the carry-case and closes the top portion or lid over the bottom portion. The traveler may then secure the portions of the carry-case shell with at least one closure. The traveler may carry, push, or pull the carry-case by at least one handle attached to at least one side of the exterior portion of the carry-case and that may be stationary or may be expandable. The traveler may push or pull the carry-case by at least one wheel attached to at least one side of the exterior portion of the carry-case.

GLOSSARY

"apparatus" as used herein means a portable combined bed and storage.

"carry-case" as used herein means a soft-bodied, or structured case capable of being opened and closed and capable of providing storage for a bed and other items.

"shell" as used herein means the exterior body of a carry-case.

"storage module" as used herein means a shelf, pocket, pouch, hanger rack, drawer, or bin.

"bed" as used herein means a mattress coupled with sheets and/or blankets.

"mattress" as uses herein means a foldable, rollable, collapsible, or compressible mat.

"partition" as used herein means a textile or solid structure, such as a thin wood layer, capable of separating at least two interior portions of a carry-case.

"wheel" as used herein means any circular structure with an axel capable of being attached to a carry-case to facilitate movement of a carry-case about a surface.

"barrier" as used herein means a textile or solid material capable of protecting interior contents from exterior elements.

"frame" as used herein means a support structure that may be firm or collapsible.

"hinge" as used herein means and joint, swing, or elbow hinge capable of allowing a casing with two parts open while both parts are secured to the hinge.

"closure" as used herein means an apparatus such as a padlock system, combination lock system, snap, buckle, hook-and-loop attachment, zipper, latch, or clip capable of securing two parts of a casing together.

"fastener" as used herein means at least one apparatus capable of joining two separate materials or parts or two parts of the same material or of the same object substantially together. Examples of fasteners are hook and-loop closures, tape, adhesive, buttons, hook-and-eye closures, zippers, latches, clips, locks, hinges, grommets, or buckles.

DETAILED DESCRIPTIONS OF THE DRAWINGS

Referring to FIG. 1, a perspective view of an exemplary portable combined bed and storage in an open position is illustrated. Specifically, an apparatus 1 contains a carry case 3 comprising a top portion 17 connected to a bottom portion 19 by a hinge 25, and least one side 23 for a polygonal or spherical shape. The carry case may comprise a handle 9 that may be be retractable, expandable, or fixed. The carry case can be made of a shell 27 having one or more sides 23. The shell 23 defines an interior space 13 and an exterior space 15. The interior space 13 may contain a bed 11 having a pillow 5 and linens 7. The interior space may additionally contain a least one storage module 21.

The carry-case may contain multiple handles, wheels, and closures. The carry-case may be placed in a longitudinal or lateral position. A mattress with linens and pillow are stored in the bottom portion of the shell interior space. The top portion may contain storage modules. The bottom portion houses the mattress and linens. In some embodiments, the bottom portion may also have room to contain additional travel accessories, clothes, toiletries, and linens. The top portion and the bottom portion may have varying depths to allow different storage configurations. Storage modules provide added organization and protection of travel accessories, clothing, toiletries, and extra linens and pillow. Storage modules may be present in the top and/or the bottom interior portions.

For compact configurations, the top portion may be flat. Storage modules in the top portion interior of the shell provide extra room and organization for clothing and shoes while the mattress is folded and stored in the bottom portion. However, in some embodiments, storage modules may be absent, and travel accessories, toiletries, clothes, and linens may simply be placed on top of the stowed folded mattress. A compact configuration is shown where the top portion is not fully detached from the bottom portion. The bed can unfold from the interior portion and be ready for use.

An exemplary frame later shown in FIG. 4 may be made from PVC pipe and pipe connectors in a rectangular or square shape. The frame may have additional connectors along its sides to allow for interior support structures such as a mattress frame or for storage modules. In one example, mesh with elastic outer frame may be attached to the frame sides and may or may not be repositionable. A hard-shell case may be made with soft materials such as vinyl and then fastened to a rigid frame that may be reinforced with layers of different material depending on desired durability. For easy maneuverability, wheels and handles may be attached to at least one exterior side.

Figure 2A:
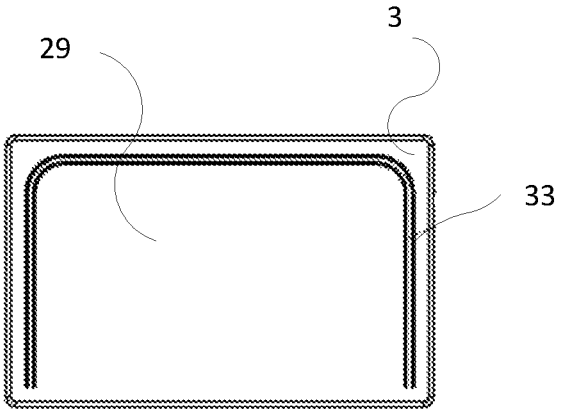
FIG. 2A illustrates a frontal view of an exemplary apparatus front access cover in a closed position.
Figure 2B:
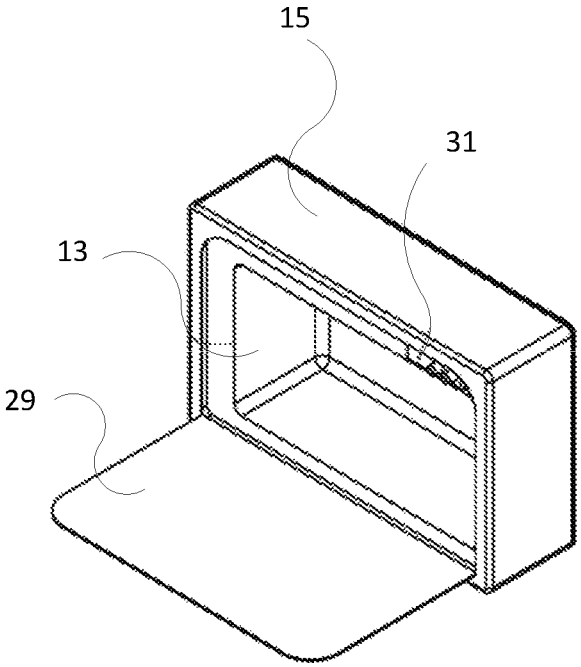
FIG. 2B illustrates a perspective view of an exemplary apparatus in an open position.
Figure 2C:
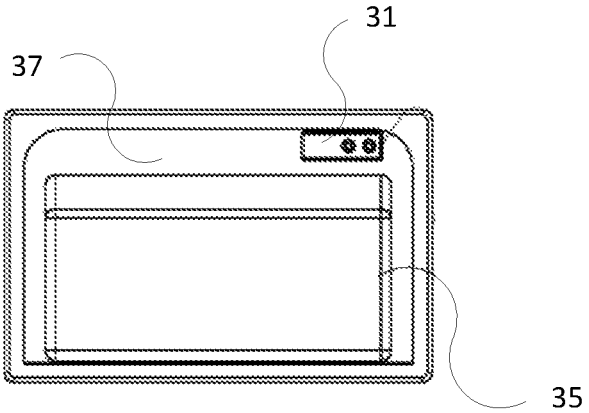
FIG. 2C illustrates a frontal perspective of an interior space of an exemplary apparatus.

Referring now to FIG. 2A, FIG. 2B, and FIG. 2C, several views of an interior space of an exemplary apparatus are illustrated, FIG. 2A illustrates a frontal view of an exemplary apparatus front access cover in a closed position, FIG. 2B illustrates a perspective view of an exemplary apparatus in an open position and FIG. 2C illustrates a frontal perspective of an interior space of an exemplary apparatus. Specifically, an exemplary embodiment of a carry case 3 has a front access cover 29 and a closure 33. The closure 33 forms a perimeter around the front access cover 29. The closure 33 may be opened or closed to reveal or conceal the interior space 13 or to present and define the exterior space 15. The interior space 13 may house a mattress 35. The mattress 35 in this exemplary embodiment is an inflatable air mattress that may be inflated by an air pump 31. The air pump 31 may be attached and built in with the mattress 35 in the interior space 13 or may be removable. The air pump may be manually operated or electronically operated when coupled with a power source. A barrier 37 may be fixably or removably attached to the interior space 13 to separate the mattress 35 from other items stored in the interior space 13.

Figure 3A:
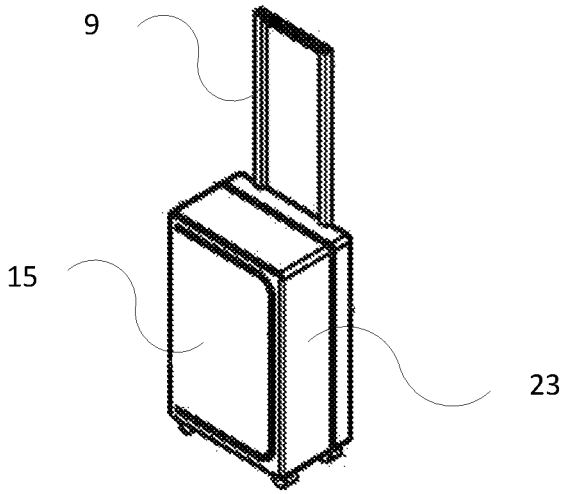
FIG. 3A illustrates a perspective view of an exterior space of an exemplary apparatus.
Figure 3B:
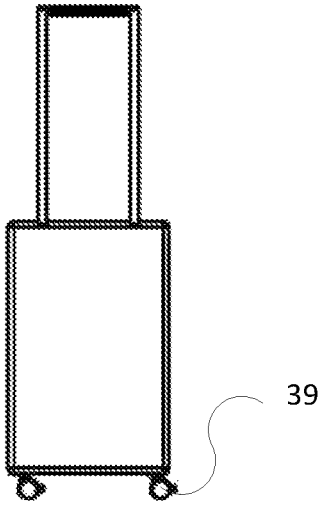
FIG. 3B illustrates a rear view of an exterior space of an exemplary apparatus.
Figure 3C:
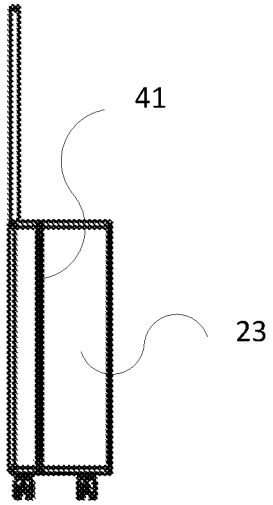
FIG. 3C illustrates a side view of an exterior space of an exemplary apparatus.
Figure 3D:
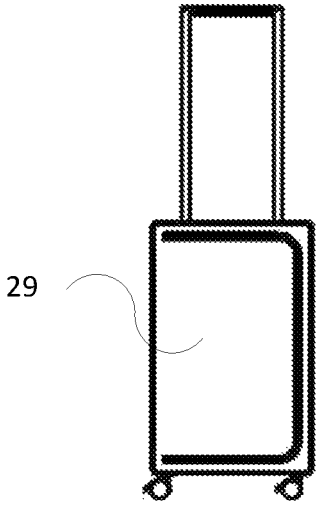
FIG. 3D illustrates a frontal view of an exterior space of an exemplary apparatus.

Referring now to FIG. 3A, FIG. 3B, FIG. 3C, and FIG. 3D, several views of an exterior space of an exemplary apparatus are illustrated. FIG. 3A illustrates a perspective view of an exterior space of an exemplary apparatus, FIG. 3B illustrates a rear view of an exterior space of an exemplary apparatus, FIG. 3C illustrates a side view of an exterior space of an exemplary apparatus, and FIG. 3D illustrates a frontal view of an exterior space of an exemplary apparatus.

In some embodiments, an apparatus 1 may contain at least one wheel 39 for maneuverability. The wheel 39 may be retractable. In preferred embodiments, the wheel 39 may have locks that can be engaged and disengaged. The wheel 39 may rotate up to 360 degrees about a center. The apparatus 1 may be pushed or pulled at the handle 9. The handle may be fixed or retractable and expandable. A partition 41 may separate the interior contents and may be visible on the exterior space 15 or may be concealed in the interior space. A front access cover 27 may be present on at least one side 23.

In preferred embodiments, a hard-shell case is used where the carry-case is comprised of a top portion or lid and a bottom portion. The top and bottom are preferably connected at at least one side by at least one hinge and a closure on the opposing side. However, in some embodiments, a lid may be comprised of two portions that open outward from the center of the carry-case. Handles and wheels may provide for easy maneuvering. Likewise, a semi-hard-shell case may be used having a rigid frame and soft sides with a front access cover.

Figure 4:
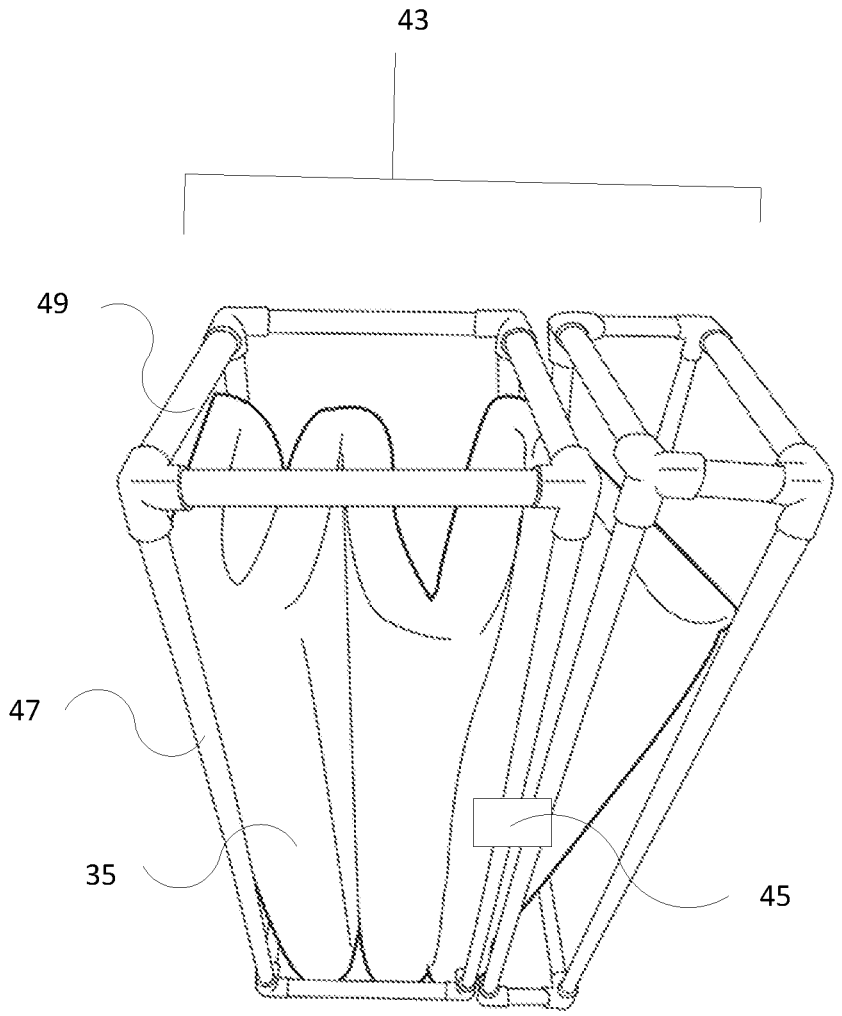
FIG. 4 illustrates a side perspective view of an exemplary embodiment of a mattress in a folded position and frame in a closed position.

Referring now to FIG. 4, a side perspective view of an exemplary embodiment of a mattress in a folded position and frame in a closed position is illustrated. A frame 43 may comprise a plurality of pipe 49 arranged in a lattice to provide structure and support for the mattress 35. The mattress may be attached to a base frame 47. The base frame 47 may be more sturdy and larger than the remainder of the frame 43. The base frame 47 may be housed in larger shell interior space and may be connected to the remainder of the frame 43 by a fastener 45. The base frame 47 may open away from the center of the mattress 35, to reveal a flattened mattress, about the position of the fastener 45 that is connected to at least two portions of pipe 49.

In some embodiments, a cardboard or wood layer that may be a partition or may be a reinforcement of the interior portion of the carry-case shell. Regarding the mattress, padding may incorporate a fixedly or removably attached pillow and linens for quick and easy opening and closing. The foldability and compactness allowed by a segmented and lightweight mattress frame is demonstrated where the mattress frame is comprised of PVC pipes and connectors and bungee cords in an internal cross frame. The mattress frame is capable of accommodating a variety of mattress weights, densities, and thicknesses. Segmented portions of a mattress frame connected by PCV pipe connectors allow for easy folding and unfolding. The mattress frame is in the longitudinal position and demonstrates the exemplary compressibility and foldability of a mattress.

In some embodiments, the mattress may already be fabricated into a bed with a removable fitted sheet and flat sheet, and sometimes a mattress cover. The mattress may be segmented or may be a solid sheet of padding or foam. A fastener or hinge connects a two-portion mattress frame. The top portion of the mattress frame or frame head preferably has a lesser depth than that of the second bottom portion or frame foot. The portions correspond to the interior portions of the shell of the carry-case. In some embodiments, tape or adhesive may be used to connect the mattress frame portions while allowing lightweight and easy unfolding of the mattress frame.

Figure 5A:
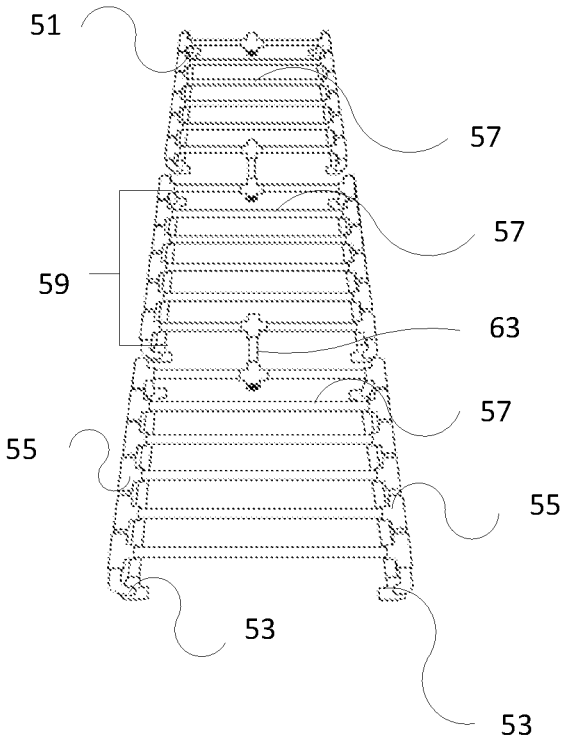
FIG. 5A illustrates a top perspective view of an exemplary embodiment of a mattress frame in an open position.
Figure 5B:
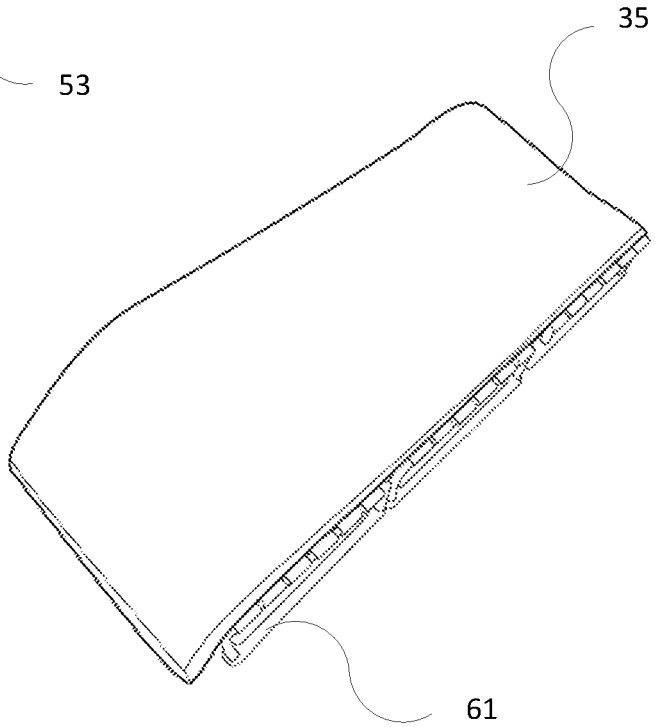
FIG. 5B illustrates a top perspective view of an exemplary embodiment of a mattress frame in an open position and topped with a mattress.

Referring now to FIG. 5A and FIG. 5B, two views of an exemplary frame are shown. FIG. 5A illustrates a top perspective view of an exemplary embodiment of a mattress frame in an open position, and FIG. 5B illustrates a top perspective view of an exemplary embodiment of a mattress frame in an open position and topped with a mattress. The mattress 35 may be supported by a frame 43 comprised of segments 59 of frame legs 55 perpendicularly connected to at least one cord 57 in a ladder-like lattice whereby two sets of frame legs 55 are positioned parallel to one another and connected in the center perpendicularly with cord 57. This resulting cross support structure 61 supports the weight of the mattress 35 and of the user. Each segment may contain two frame legs 55 and six cords 57 evenly spaced apart. A frame 43 may comprise two, three, or four segments 59. The segments 59 may be connected to one another with a connector 63 positioned in the center of the length of cord 57. Each segment 59 can fold onto the other about the connector 63 that allows for rotation. Unfolded, the frame 43 has a frame head 51 and a frame foot 53 about which the mattress 35 is spread out and laid flat when in an open configuration.

In some embodiments, a series of hinges or alternatively fasteners, along with support structures, allow for a combination of easy stowage, easy use, and compact and lightweight closure. In the open position, the mattress frame which may be segmented, unfolds from the interior portion of the carry-case shell. In some embodiments, a mattress frame will have an internal cross frame that is preferably segmented to allow for easy folding. In some embodiments, the internal cross frame may be compressible rather than rigid and be made from nylon cord or bungee cord similarly to a cot. A mattress frame may also contain legs that may or may not be foldable or adjustable. The legs will elevate the mattress off the ground to allow for greater comfort and expandability and compressibility room when a traveler lies down on the mattress.

In some embodiments, the top portion of the shell may be removed from the bottom portion rather than remaining attached with hinges on a side. In some embodiments where the top may be removed completely, it may be repositioned at the foot of the pull-out mattress frame to provide support and stability such as with a headboard and footboard configuration. The bottom portion may be deeper than the top portion and may be lined in fabric or other material. A base frame or partial mattress frame may be attached to the bottom interior portion of the shell to allow for interchangeable and removable mattress frames. The mattress frame may be secured to the base frame with a hinge or fastener. For example, a wood or cardboard layer may be used as an interior partition to separate storage modules or as a reinforcement for the top portion of the interior side of the shell.

In some embodiments, the mattress may be a solid sheet of foam or other type of supportive mat material. The material may be cut to meet the size requirements of the mattress frame, or the mattress frame may be made to accommodate a specific mattress size. In some embodiments, the carry-case may be made larger than the space required to accommodate a mattress frame to allow for interchangeable mattresses and mattress frames. This may especially be useful for when children outgrow their current mattress. The mattress padding may be secured to the mattress frame with at least one fastener. Mattress frame legs may allow for elevation off the ground that is flush with the depth of the bottom portion of the carry case when the carry case is lying flat on the ground.

Figure 6A:
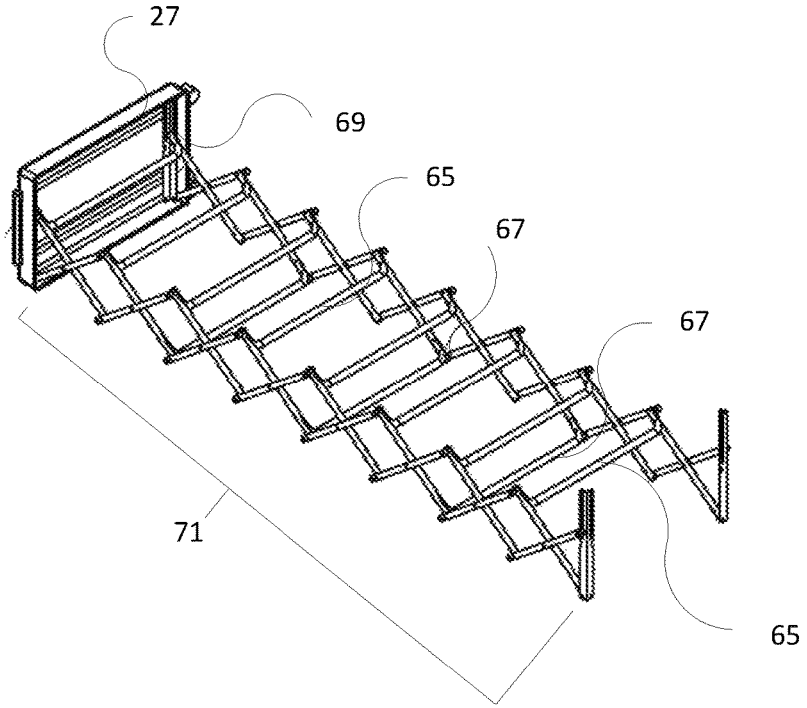
FIG. 6A illustrates a top perspective view of an exemplary scissor frame assembly in an open position
Figure 6B:
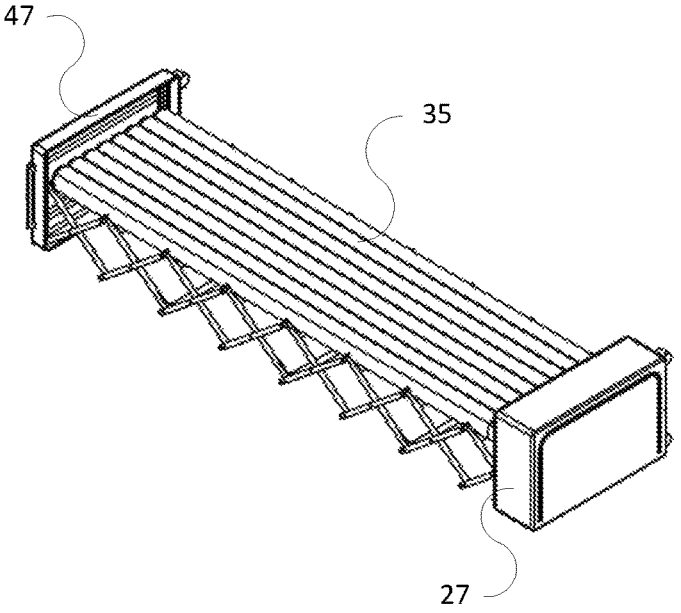
FIG. 6B illustrates a top perspective view of an exemplary scissor frame assembly in an open position and topped with a mattress.

Referring now to FIG. 6A and FIG. 6B, two views of an alternative exemplary frame are shown. FIG. 6A illustrates a top perspective view of an exemplary scissor frame assembly in an open position, and FIG. 6B illustrates a top perspective view of an exemplary scissor frame assembly in an open position and topped with a mattress. In some embodiments, the apparatus 1 may have a frame 43 comprised of a scissor frame assembly 71. The scissor frame assembly 71 contains a lattice of a plurality of upper cross supports 65 and lower cross supports 67. The scissor frame assembly 71 may be attached to the shell 27 by the base frame 47 at a scissor mounting bracket 69 attached to the shell 27 in the interior space 13. The mattress may be unfolded or inflated and lie on top of the scissor frame assembly 71. The mattress 35 may be fixably or removably attached to at least one upper cross support 65.

Referring now to the method steps for assembling a portable combined bed and storage carry-case, assembly may be performed with the following items: hollow or solid sticks, pipes, or tubes that may or may not be compressible; faux leather shell; fasteners; exterior accessories such as handles, wheels, tags, pockets, or decorations; buckle closures; locks; hinges; sheet of mattress padding; elastic, cardboard, wood, and/or mesh partitions; wood frame or PVC pipe frame with corner connectors.

A frame may be built to the desired size specification according to desired bed and storage capacity. Therefore, it will be helpful to first determine the desired storage capacity. Preferred embodiments for children's sizes are approximately 30 inches×28 inches×13 inches although, other sizes are contemplated and are within the scope and intent of this disclosure. The shape may also be varied to the consumer's liking and may include square and round in addition to rectangle as previously shown and described. A preferred mattress thickness may be from approximately 1 inch such as for a naptime mat to approximately 6 inches for therapeutic type mattresses. A preferred embodiment may have a mattress thickness of approximately 2 inches.

A mattress support frame with legs is assembled according to the measurements of the mattress or with the full bed including the sheets and/or blankets. The frame is preferably constructed in two parts: the first to fit within the anticipated bottom portion of the interior space of the carry-case, and the second to fit within the anticipated top or lid portion of the interior space of the carry-case. The two mattress support frames are hinged at at least one point by applying an adhesive tape or other hinge as previously shown and described. The mattress support frame is constructed by assembling the outer frame with pipe connectors facing inward. The pipe connectors receive cross support structures that stabilize the mattress support frame and provide support for lying on the mattress that will be placed and secured on the top and over the cross-support structures with fasteners as previously shown and described. The cross-support structures may be grouped into segments connected by pipe connectors that allow folding of the mattress support structure as previously shown and described in the open position and in the closed position.

The frame may be fixed to the interior space side of the shell at one end by at least one hinge or other fastener. Once attached, the mattress frame with the attached mattress is folded or collapsed into the interior space and previously shown and described. On the other side of the interior space of the shell, storage modules or compartments are constructed with pockets or partitions that may be fixedly or removably attached to the interior side of the shell.

Figure 7:
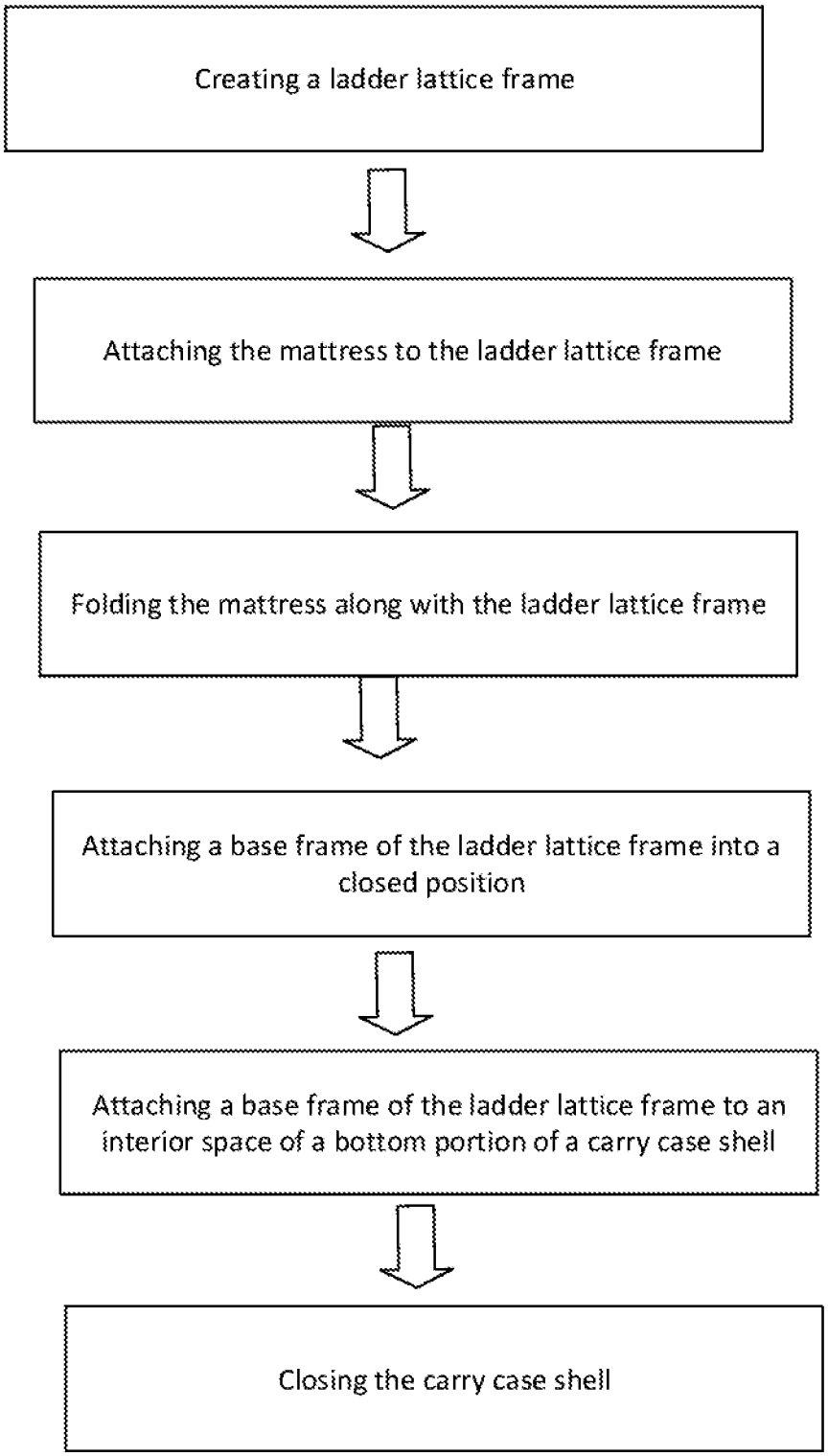
FIG. 7 illustrates exemplary method steps of assembly.

Turning to FIG. 7, exemplary method steps of assembly are shown. A person may assemble a portable combined bed and storage apparatus comprising a carry case having a shell with a top portion and a bottom portion that define an interior space and an exterior space; a handle on a side of the exterior space; at least one wheel; and a bed comprising a mattress connected to a ladder lattice frame, the method steps comprising: creating a ladder lattice frame, attaching the mattress to the ladder lattice frame, folding the mattress along with the ladder lattice frame into a closed position; attaching a base frame of the ladder lattice frame to an interior space of a bottom portion of a carry case shell; and closing the carry case shell.

CONCLUSION

A number of embodiments of the present disclosure have been described. While this specification contains many specific implementation details, there should not be construed as limitations on the scope of any disclosures or of what may be claimed, but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations and method steps are depicted in the drawings in a particular order or described in the Detailed Description, this should not be understood as requiring that such operations and method steps be performed in the particular order shown or in sequential order, or that all illustrated operations be performed, to achieve desirable results.

Thus, particular embodiments of the subject matter have been described. Other embodiments are within the scope of the following claims. In some cases, the actions recited in the claims can be performed in a different order and still achieve desirable results. Nevertheless, it will be understood that various modifications may be made without departing from the spirit and scope of the claimed disclosure.

What is claimed is:

1. A portable combined bed and storage apparatus, the apparatus comprising:

a carry case having a shell with a top portion and a bottom portion that define an interior space and an exterior space;

a handle on a side of the exterior space;

at least one wheel on the bottom portion exterior space; and a bed encased inside the shell, wherein the bed comprises a mattress attached to a frame having a ladder lattice configuration.

2. The portable combined bed and storage apparatus according to claim 1 further comprising a front access cover and a closure.

3. The portable combined bed and storage apparatus according to claim 1 wherein the mattress is an inflatable air mattress.

4. The portable combined bed and storage apparatus according to claim 3 further comprising an air pump.

5. The portable combined bed and storage apparatus according to claim 1 wherein the frame is constructed in two parts:

a base frame to fit within a bottom portion of the interior space, and a second frame to fit within a top portion of the interior space.

6. A method of assembling a portable combined bed and storage apparatus comprising a carry case having a shell with a top portion and a bottom portion that define an interior space and an exterior space; a handle on a side of the exterior space; at least one wheel; and a bed comprising a mattress connected to a ladder lattice frame, the method steps comprising:

creating the ladder lattice frame, attaching the mattress to the ladder lattice frame, folding the mattress along with the ladder lattice frame into a closed position;

attaching a base frame of the ladder lattice frame to the interior space of a bottom portion of a carry case shell; and closing the carry case shell.

* * * * *